US006021731A

United States Patent [19]

French et al.

[11] Patent Number: 6,021,731

[45] Date of Patent: Feb. 8, 2000

[54] BALLAST SYSTEM FOR UNDERWATER VEHICLE

[75] Inventors: Daniel W. French, Portsmouth, R.I.; Theodore C. Gagliardi, Somerset, Mass.; Steven L. Camara, Riverside, R.I.; John J. Vaillancourt, Tiverton, R.I.; David Nugent, Newport, R.I.

[73] Assignee: The United States of America as represented by the Secretary of the Navy, Washington, D.C.

[21] Appl. No.: 09/120,874

[22] Filed: Jul. 14, 1998

[51] Int. Cl.[7] ..... B63G 8/14

[52] U.S. Cl. ..... 114/331; 114/121; 441/28

[58] Field of Search ..... 114/312, 331, 114/121, 317; 441/7, 28, 29

[56] References Cited

U.S. PATENT DOCUMENTS 3,683,835 8/1972 Deslierres ..... 114/331

4,823,722 4/1989 Gass ..... 114/256

*Primary Examiner*—Jesus D. Sotelo

*Attorney, Agent, or Firm*—Michael J. McGowan; James M. Kasischke; Prithvi C. Lall

[57] ABSTRACT

A ballast weight system for releasably attaching a ballast weight to an underwater vehicle is disclosed where the system comprises a ballast weight, a housing disposed about the ballast weight, a fairing connected to the ballast weight to facilitate a flush connection of the ballast weight to the underwater vehicle, and a bolt coupler where one end of the bolt receives a lanyard pin therethrough and the second end connects a spring loaded bolt connected to the ballast weight. A linear actuator is connected to the lanyard pin. The lanyard pin placed through the bolt maintains the spring loaded bolt in spring compression such that when the pin is removed, the spring compression propels the ballast weight away from the housing.

12 Claims, 1 Drawing Sheet

BALLAST SYSTEM FOR UNDERWATER VEHICLE

STATEMENT OF GOVERNMENT INTEREST

The invention described herein may be manufactured and used by or for the Government of the United States of America for governmental purposes without payment of any royalties thereon or therefor.

BACKGROUND OF THE INVENTION (1) Field of the Invention

The present invention relates to a novel construction for a ballast system for an underwater vehicle. More particularly, the invention relates to an encapsulated ballast weight releasable via a spring loaded bolt held in spring tension by a lanyard pin and linear actuator.

(2) Description of the Prior Art

It is often desirable to allow an underwater vehicle to trim its buoyancy as close as possible to a neutral buoyancy while running its mission. It is often difficult to provide controllability, safety and ease of slow-speed maneuvers by trimming an underwater vehicle by means other than a ballast weight system. By carrying a releasable ballast weight, the vehicle may discard the ballast weight thereby becoming positively buoyant and becoming capable of floating to the surface of the water. After an underwater mission has been completed and the ballast weight discarded, the buoyant vehicle becomes more easily recoverable.

Prior ballast weight systems have used explosive-type release mechanisms, such as squibs and explosive bolts. Although relatively safe, explosive bolts present a danger to personnel working with the underwater vehicle prior to its launch as well as during and after its recovery if an unexploded bolt is still present.

SUMMARY OF THE INVENTION

It is a general purpose and object of the present invention to provide a releasable ballast weight that releases from an underwater vehicle in a non-explosive manner.

It is another object of the present invention to provide a ballast weight that is relatively compact in comparison to the displacement of an underwater vehicle.

The invention is directed to a ballast weight system for releasably attaching a ballast weight to an underwater vehicle. The system includes a ballast weight, a housing disposed about the ballast weight, a fairing connected to the ballast weight to facilitate a flush connection of the ballast weight to the underwater vehicle, a spring loaded bolt, a bolt coupler, and a lanyard pin. The bolt coupler connects to the spring loaded bolt at one end and at the other end the bolt coupler receives a lanyard pin therethrough. A linear actuator is connected to the lanyard pin. The lanyard pin is placed through the bolt coupler and maintains the spring loaded bolt in spring tension. When the lanyard pin is removed, the spring tension propels the ballast weight away from the underwater vehicle. The ballast weight is typically mounted on the bottom of the underwater vehicle, in this case spring energy and gravity propel the negatively buoyant ballast weight away from the vehicle.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein.

DESCRIPTION OF THE PREFERRED EMBODIMENT

The present invention generally comprises a ballast weight, a housing disposed about the ballast weight, a fairing connected to the ballast weight to facilitate a flush connection of the ballast weight to the underwater vehicle, a spring loaded bolt, a bolt coupler, and a lanyard pin.

Figure 1:
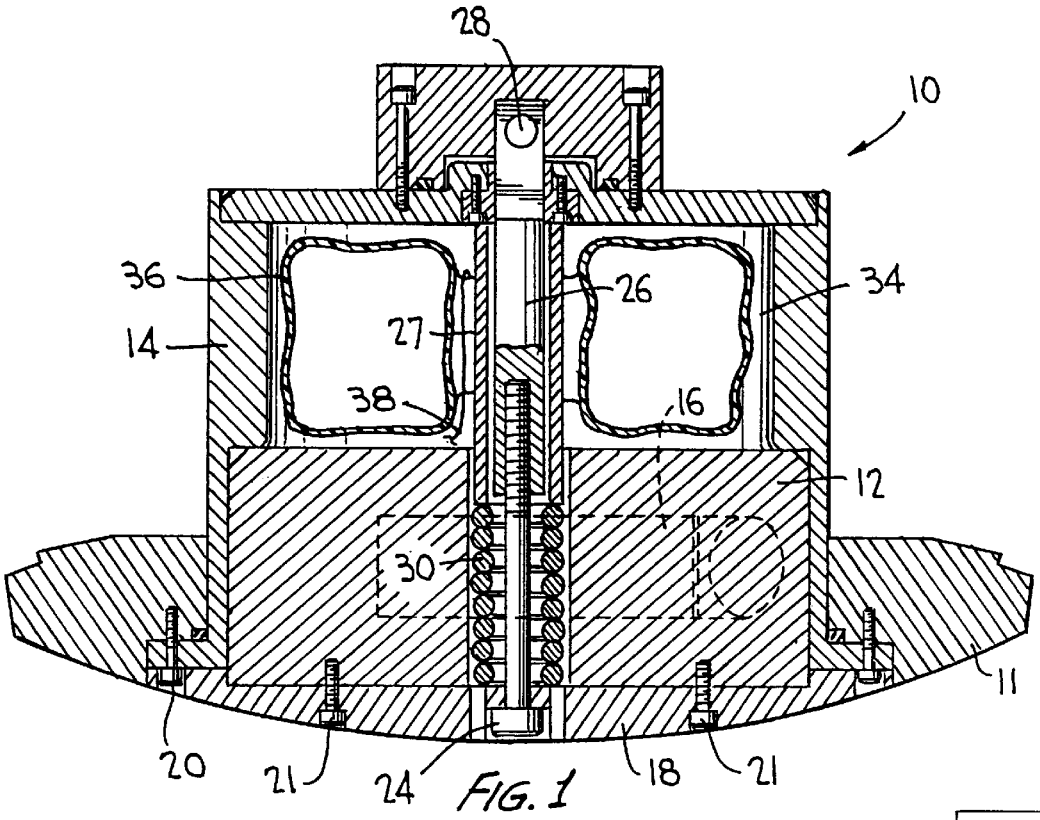
FIG. 1 is a sectional end view of the components of the present invention.
Figure 2:
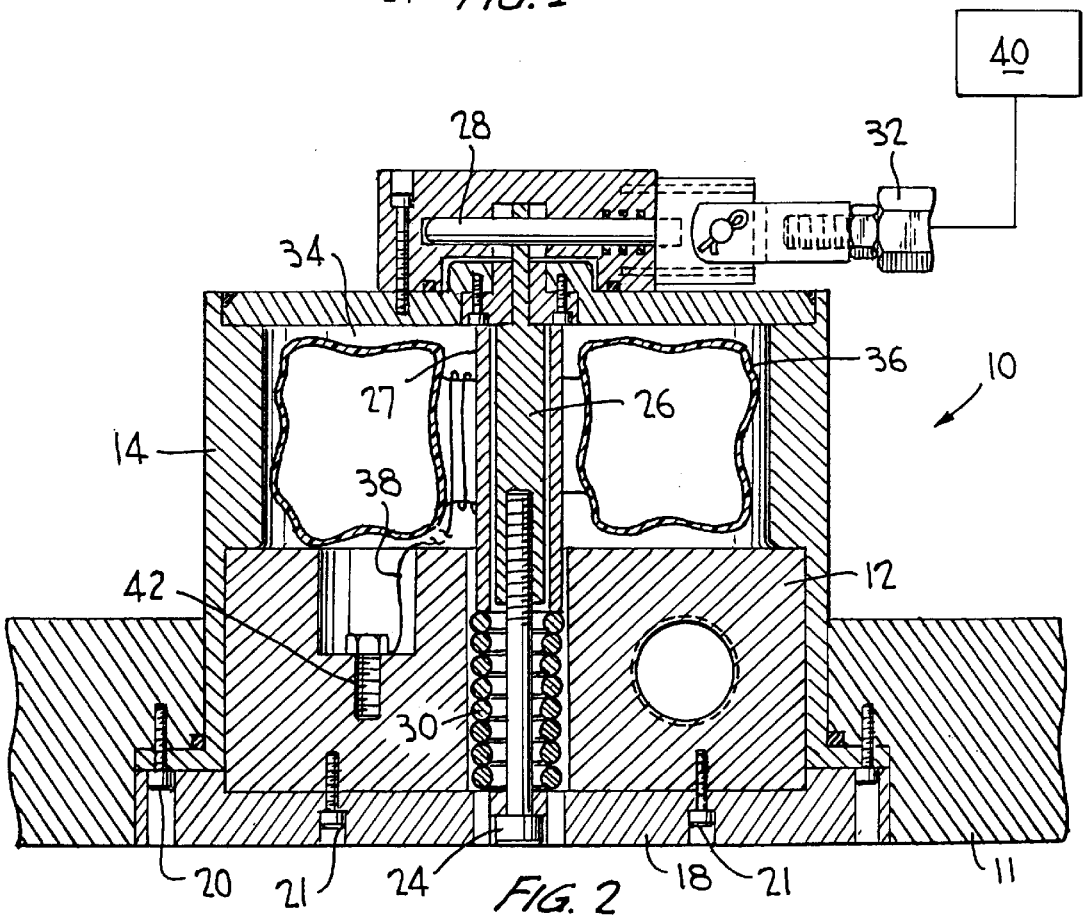
FIG. 2 is a sectional side view of the components of the present invention of FIG. 1.

Turning to FIGS. 1 and 2, the ballast weight system 10 comprises a weight 12 encapsulated in a housing 14, preferably of stainless steel and shaped in the form of a cylindrical cannister. The housing 14 is mounted by cap screws 20 in a cylindrical underwater vehicle hull 11. The weight 12 is preferably formed of tungsten, stainless steel or lead, though other materials, preferably dense materials, may also serve as the ballast weight. Optionally encapsulated within the weight 12 is a salt water activated pinger 16 that emits an acoustic signal that may be received to indicate the location of the weight 12 thereby allowing easy retrieval of the detached weight. A ballast weight cover or fairing 18 is also attached to the weight 12 to allow it to mount flush with the underwater vehicle 11. The fairing 18 is connected by bolts or cap screws 21 to the ballast weight 12. Fairing 18 has apertures therein allowing access to housing mounting screws 20.

The weight 12 is attached to an underwater vehicle by the spring loaded bolt 24, a bolt coupler 26, and a lanyard pin 28. The bolt coupler 26 connects to the spring loaded bolt 24 at one end and at the other end the bolt coupler 26 has a hole to receive a lanyard pin 28 therethrough. A spring extender sleeve 27 maintains the spring 30 in position at one end. The spring 30 is shown in compressed position between extender sleeve 27 and bolt 24. A linear actuator 32 (FIG. 2) is connected to the lanyard pin 28. The lanyard pin 28 placed through the bolt coupler 26 maintains the spring loaded bolt 24 in spring compression. When the lanyard pin 28 is removed from the hole in the bolt coupler 26, the compressed spring 30 propels the ballast weight away from the underwater vehicle 11. The linear actuator 32 may be joined to a control device 40 such as an electronic interface system which is in communication with an on-board computer.

The ballast weight system may also include a buoy 36 having a tether 38 joined to the weight 12 such that the weight may be recovered from the surface of the water. The housing 14 and the weight 12 define a chamber 34 in which buoy 36 is located until weight 12 is discharged. Buoy 36 is typically a dumb bell shaped float having tether 38 wrapped about the center of the buoy 36. Tether 38 is anchored to the weight 12 at attachment point 42. When the weight 12 is released, tether 38 unrolls from buoy 36 and prevents weight 12 from sinking. The spring extender sleeve 27, typically made from a plastic material, although other rigid materials can be used, provides a solid core inside the chamber 34. This spring extender sleeve 27 keeps the tether and buoy from fouling or tangling in the spring 30 coils.

When the underwater vehicle needs to be trimmed to a positive buoyancy, such as at the end of operation or in an emergency, the on-board computer releases the weight 12 via a signal sent through an electronic interface system which causes linear actuator 32 to release lanyard pin 28. The underwater vehicle may then float to the surface of the water to be retrieved.

Obviously, this invention could be modified to create a device for trimming a vehicle to a negative buoyancy. In such an embodiment, weight 12 could be a buoy positioned on an underwater vehicle. Other structures can be adapted as necessary.

In light of the above, it is therefore understood that within the scope of the following claims, the invention may be practiced otherwise than as specifically described.

What is claimed is:

1. A ballast weight system for releasably attaching a ballast weight to an underwater vehicle, the system comprising:

a housing joined to said vehicle;

a ballast weight disposed in said housing;

a spring loaded bolt connected to said ballast weight;

a lanyard pin slidably joined in said housing;

a bolt coupler having a first end adapted to receive said lanyard pin therethrough and a second end connected to said spring loaded bolt; and said lanyard pin slidably positioned in said bolt coupler first end maintaining the spring loaded bolt in spring compression against said housing and subsequent sliding of said lanyard pin causes sudden discharge of said spring compression thereby releasing said ballast weight from said housing.

2. The invention of claim 1 further comprising a fairing connected to said ballast weight for facilitating a hydrodynamic connection between the ballast weight and the underwater vehicle.

3. The invention of claim 1 further comprising a linear actuator connected to the lanyard pin for slide actuation of said lanyard pin.

4. The invention of claim 3 further comprising a saltwater activated signal transmitter connected to said ballast weight.

5. The invention of claim 3 wherein said housing is formed of stainless steel.

6. The invention of claim 3 wherein said ballast weight is formed from a material selected from the group consisting of tungsten, stainless steel, and lead.

7. The invention of claim 3 further comprising a control device joined to said linear actuator.

8. The invention of claim 1 further comprising a buoy connected to said ballast weight to float said ballast weight in a body of water.

9. The invention of claim 8 wherein said buoy is stored in said housing before release of said ballast weight.

10. The invention of claim 1 further comprising a spring extender sleeve disposed about said spring loaded bolt and bolt coupler combination, said spring extender sleeve having a first end joined to said housing and a second end compressing said spring loaded bolt spring.

11. The invention of claim 1 further comprising a buoy connected to said ballast weight to float said ballast weight in a body of water.

12. The invention of claim 11 further comprising a spring extender sleeve disposed about said spring loaded bolt and bolt coupler combination, said spring extender sleeve having a first end joined to said housing and a second end compressing said spring loaded bolt spring.

* * * * *